US007857044B2

(12) United States Patent
Grotherr et al.

(10) Patent No.: US 7,857,044 B2
(45) Date of Patent: Dec. 28, 2010

(54) TOOL MANIPULATOR ESPECIALLY FOR ONSHORE AND OFFSHORE DRILLING PLATFORMS

(75) Inventors: Joern Grotherr, Halstenbek (DE); Nils Rueger, Burgdorf (DE)

(73) Assignee: Blohm + Voss Repair GmbH, Hamburg (DE)

( * ) Notice: Subject to any disclaimer, the term of this patent is extended or adjusted under 35 U.S.C. 154(b) by 156 days.

(21) Appl. No.: 12/381,880

(22) Filed: Mar. 16, 2009

(65) Prior Publication Data

US 2009/0274543 A1 Nov. 5, 2009

(30) Foreign Application Priority Data

Apr. 30, 2008 (DE) ..... 10 2008 022 134
Dec. 5, 2008 (DE) ..... 10 2008 060 835

(51) Int. Cl.
*E21B 19/00* (2006.01)
*B66C 23/18* (2006.01)
*B25J 17/02* (2006.01)
*B25J 18/00* (2006.01)

(52) U.S. Cl. ..... 166/85.1; 173/39; 414/744.3; 74/490.01

(58) Field of Classification Search ..... 175/85, 175/52; 166/77.51, 85.1; 173/184, 18, 112, 173/39; 299/75, 76; 81/54; 187/234; 414/744.3; 901/16, 22; 74/490.1
See application file for complete search history.

(56) References Cited

U.S. PATENT DOCUMENTS 3,709,379 A * 1/1973 Kaufeldt ..... 414/591
3,760,956 A * 9/1973 Burch ..... 414/744.3
3,780,815 A * 12/1973 Barron et al. ..... 173/195
3,921,820 A * 11/1975 Crockett ..... 198/750.11
4,005,782 A * 2/1977 Crockett ..... 414/591
4,013,178 A * 3/1977 Brown et al. ..... 414/22.63
2001/0025727 A1 * 10/2001 Byrt et al. ..... 175/7

FOREIGN PATENT DOCUMENTS

WO WO 87/04754 * 8/1987

* cited by examiner

*Primary Examiner*—Kenneth Thompson
*Assistant Examiner*—Sonya Bible
(74) *Attorney, Agent, or Firm*—W. F. Fasse; W. G. Fasse

(57) ABSTRACT

A manipulator apparatus carries tools for connecting drill-pipes to the drillstring in a wellbore on a drilling platform. A telescopically extendable horizontal work arm is carried on a telescopically extendable vertical column, and the tools are to be mounted on a free end of the work arm. The column is manually rotatable about a vertical axis. The column and the work arm are each respectively formed of a fixed element and a telescopically extendable element. The fixed element is preferably formed of two U-profile members arranged back-to-back, and the extendable element includes an H-profile member with its web received between the webs of the two U-profile members. This forms a telescopic slide bearing of the H-profile member sliding along the two U-profile members. The hydraulic cylinders are received in the recessed spaces of the profile members.

16 Claims, 1 Drawing Sheet

TOOL MANIPULATOR ESPECIALLY FOR ONSHORE AND OFFSHORE DRILLING PLATFORMS

PRIORITY CLAIM

This application is based on and claims the priority under 35 U.S.C. §119 of German Patent Applications 10 2008 022 134.1, filed on Apr. 30, 2008 and 10 2008 060 835.1, filed on Dec. 5, 2008, the entire disclosures of which are incorporated herein by reference.

FIELD OF THE INVENTION

The invention relates to a manipulator for carrying and positioning tools, especially controllable screwing and clamping tools, in relation to drillpipes for drilling a wellbore on an onshore or offshore well drilling platform.

BACKGROUND INFORMATION

For drilling a wellbore from an onshore or offshore drilling platform, for example for an oil well or natural gas well, a plurality of drillpipes are connected together in succession to form a drillstring carrying the drilling bit progressively deeper into the wellbore being drilled. The individual drillpipe sections or strands are screwed together via screw threadings at their ends, sometimes additionally using threaded couplings. Thus, during the drilling operation, it is necessary to manipulate drillpipe sections into place, and to manipulate suitable screwing tools and clamping tools for screwing the screw threadings of the drillpipes to one another or to couplings interposed between successive drillpipes. Also, the screwed or threaded connections must be tightened to a respective defined proper torque. Because the drillpipes, couplings and other components are sizeable and heavy, these operations are carried out with correspondingly heavy and sizeable clamping tools, screwing tools, and the like generally known in the field of well drilling.

In view of the above, it is also known to use power-operated manipulators to carry and manipulate the tools for performing the abovementioned operations. The power-operated manipulator must be adapted to carry the respective suitable tool to a proper location with respect to the wellbore, and to enable a height adjustment of the tool relative to the top end of the drillstring in order to accommodate various heights of the top end of the last added strand or pipe section of the drillstring. Once properly positioned with respect to the drillstring, i.e. the drillpipe section or the coupling or the like, the tools carry out the necessary operations mentioned above.

It is known to suspend tools of this type from a cable crane, and to move the crane so as to move the tool into the proper working area. Thereby the space above the wellbore is drastically limited because the crane and cable equipment must be positioned directly above the wellbore. Furthermore, the entire crane structure takes up relatively much space, especially in the height direction above the wellbore. Another problem with the known cable crane suspension of the drillpipe connecting tools is that the suspension cable does not provide a fixed rigid positioning of the tools, but rather any suspended tool may start swinging or oscillating on the cable. Such an unstable position of the tool makes it difficult to bring the tool into the exactly proper position for carrying out its work.

It has further become known in the art to provide a rail-mounted and rail-guided support arrangement for carrying such tools to the wellbore location. Such rail-guided systems are rather complex, suffer a further disadvantage of being inflexible and not adaptable to various applications, and also encroach on the space around the wellbore due to the guide rails mounted on the drilling platform floor, for example.

SUMMARY OF THE INVENTION

In view of the above, it is an object of the invention to provide a manipulator apparatus for carrying and manipulating a tool, especially for an onshore or offshore drilling platform, whereby the manipulator apparatus has a compact structural size and a reduced complexity compared to the prior art due to a simplified construction and a reduced number of total parts. It is a further object of the invention to provide such a manipulator that carries the tool or tools with simple linear movements, while omitting articulated joints from the manipulator apparatus, and while avoiding pivoting or swinging motions during the manipulation. A further object of the invention is to achieve a maintenance-free operation due to a simple robust structure of the manipulator apparatus. The invention further aims to avoid or overcome the disadvantages of the prior art, and to achieve additional advantages as apparent from the present specification. The attainment of these objects is, however, not a required limitation of the presently claimed invention.

The above objects have been achieved according to the invention in a tool manipulator apparatus and especially a manipulator for carrying, manipulating and positioning drillstring connection tools such as clamping tools and screwing tools for an onshore or offshore well drilling platform. According to the invention, the manipulator apparatus comprises a vertically extending, height adjustable, variably linearly extendable, telescopic column that is rotatable about a vertical axis and is to be mounted on a drilling floor of the platform, as well as a horizontally extending, variably linearly extendable, telescoping work arm carried by the column and adapted to receive and carry controllable drillstring connecting tools such as controllable screwing tools and clamping tools for the drillpipes, couplings, or the like.

Particularly according to preferred embodiment features of the invention, the telescoping column comprises two column elements that are telescopically slidable relative to one anther to adjust the height of the vertical column, and the work arm comprises two work arm elements that are telescopically slidable relative to one another to adjust the extension length of the work arm. preferably, one of the column elements comprises two U-profile members arranged back-to-back with their U-profile webs spaced apart from one another, and the other column element comprises a H-profile or I-profile member with its web received in the space between the webs of the U-profile members. At least one or preferably two hydraulic cylinders are connected between opposite ends of the column elements to hydraulically drive the telescoping extension and retraction of the column element.

The telescopic work arm preferably has a similar construction as the telescopic column. Namely, one work arm element comprises two U-profile members arranged back-to-back with a spacing between the U-profile webs thereof, and the other work arm element comprises a H-profile or I-profile member arranged with its web received in the space between the webs of the U-profile members. One or two hydraulic cylinders extend between opposite ends of the telescopic work arm, to hydraulically drive the variable extension and retraction thereof. The work arm extends substantially horizontally, or substantially perpendicularly to the axis of the column. The front end or free end of the work arm is equipped with a suitable receiver adapted to carry the intended tool or tools.

With the above described construction, it is possible to achieve a very robust and simple structural arrangement of the manipulator apparatus, using only standardized components of steel construction, for example readily available steel I-beams and U-beams, hydraulic cylinders, connections bolts, bearing blocks, etc. Furthermore, the moveable bearing support of the column elements relative to one another and the work arm elements relative to one another is achieved simply by the mutual sliding support of oppositely lying surfaces of the column elements on each other, and of the work arm elements on each other, respectively forming slide bearings which may further be fitted with low-friction plastic (e.g. polytetrafluoroethylene) slide bearing surfaces. Namely, the web of the H-profile member slides supportedly between the webs of the U-profile members, while the flanges of the H-profile member slide outwardly along the flanges of the U-profile members with the U-profile members constrained between the flanges of the H-profile members i.e. within the profile of the H-profile member.

This overall structural arrangement achieves a very economical construction as well as an efficient utilization of the structural space without tying up a lot of space around or above the wellbore on the drilling platform. A further preferred feature of the invention provides that at least one hydraulic cylinder is arranged and received within each U-profile member, to ensure a very compact construction as well as a protected installation space for the hydraulic cylinder.

In order to ensure that the hydraulic cylinders will be loaded only under tension and compression, without any bending or pivoting moments, a further preferred feature of the invention provides that the opposite ends of each hydraulic cylinder are respectively connected to and mounted on the opposite telescoping elements via pivot bearing blocks.

In a further preferred embodiment of the invention, the hydraulic oil supply to the hydraulic cylinders is provided through fixedly installed hydraulic pipes from a hydraulic manifold arrangement, while preferably completely avoiding the use of flexible hydraulic hoses in the manipulator apparatus. Thereby, the hydraulic adjustment of the variable extension of the column and the work arm can be efficiently and precisely carried out, without hydraulic losses and lack of positioning precision due to flexing or expansion of such hydraulic hoses under pressure. Avoiding hoses also greatly reduces the inspection, maintenance and replacement work burden. This arrangement also ensures that the manipulator apparatus is a versatile, self-contained unit that is easily adaptable to many different uses, applications or installations. It is simply necessary to connect an external, controlled hydraulic oil supply to respective hydraulic supply manifolds of the column and the work arm.

BRIEF DESCRIPTION OF THE DRAWINGS

In order that the invention may be clearly understood, it will now be described in connection with an example embodiment thereof, with reference to the accompanying drawings, wherein.

DETAILED DESCRIPTION OF A PREFERRED EXAMPLE EMBODIMENT OF THE INVENTION

Figure 1:
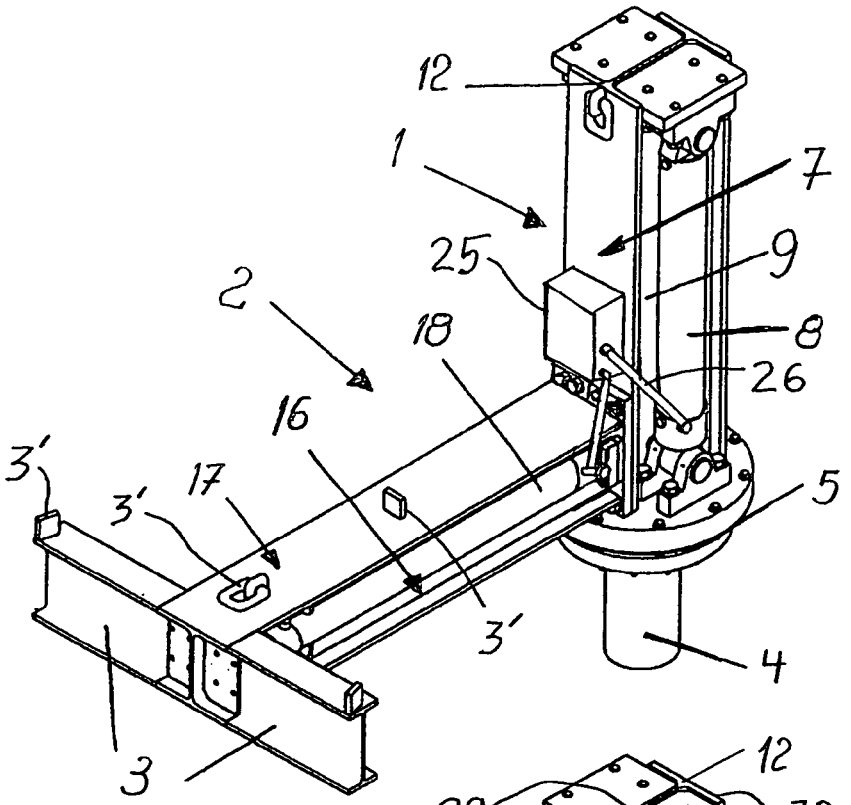
FIG. 1 is a perspective view of a manipulator apparatus according to the invention, with both the column and the work arm retracted to minimal extension positions.
Figure 2:
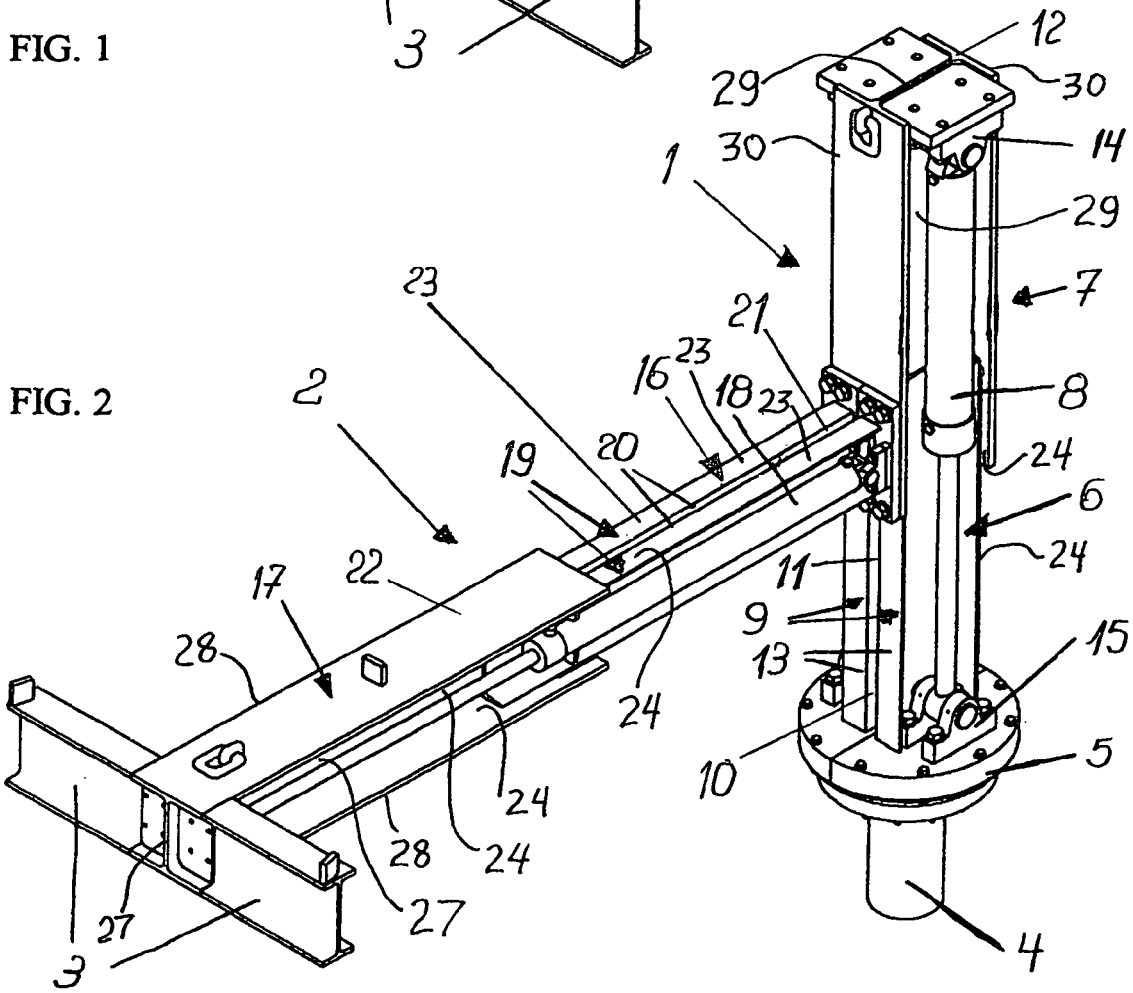
FIG. 2 is a perspective view of the manipulator apparatus similar to FIG. 1 (omitting the hydraulic manifold arrangement for simplicity), but showing a fully extended position of both the column and the work arm.

As shown in FIGS. 1 and 2, the illustrated example embodiment of a manipulator apparatus according to the invention includes a height adjustable vertical column 1 and a variably extendable horizontal work arm 2 carried by the column 1. The distal free end of the work arm 2 carries a tool receiver 3 adapted to carry the desired drillstring connection tool or tools such as clamping and screwing tools for connecting drill pipes to the drillstring in a wellbore being drilled from an onshore or offshore drilling platform. The particular tools are not shown but are well known in the pertinent art. The tool receiver 3 may be any suitable support structure for carrying the intended tools. In the illustrated example embodiment, the receiver 3 is simply a transversely extending I-beam as a transverse yoke beam with suitable tool receiver fittings 3' such as mounting lugs, mounting holes, lifting or tie-down rings, and the like. The receiver 3, the work arm 2 and the column 1 are preferably connected to one another by threaded bolts screwed into threaded holes or threaded nuts. Alternatively, a permanent welded connection may be provided.

The column 1 is bolted or welded onto a pedestal mounted on a rotation bearing 5 which is further connected to a vertically extending pipe stub 4. The pipe stub 4 is to be anchored in a suitable receiver hole in the drilling platform floor, to support the column 1 relative to the drilling platform floor. The rotation bearing 5 allows the manipulator apparatus to be rotated about a vertical axis by 360°, preferably simply by manually pushing the work arm 2 so as to rotate the column 1 into the required rotational direction.

The column 1 comprises a fixed lower column element 6 and a raisable upper column element 7 that is telescopically nested or slidingly engaged with the lower column element 6. Two hydraulic cylinders 8 are provided to hydraulically drive the adjustable extension or retraction of the upper telescopic column element 7 relative to the lower telescopic column element 6. The lower column element 6 is preferably formed by two U-profile members 9 such as steel U-beams arranged back-to-back with their respective webs 10 adjacent and spaced apart from one another by a spacing 11. The upper telescoping column element 7 preferably comprises an H-profile member 12 such as a typical I-beam of steel. For example, the H-profile member 12 is suitably embodied as a commonly known IPB profile member. This H-profile member 12 is arranged with its web 29 received in the space 11 between the two webs 10 of the U-profile members 9. Thereby the shanks or legs 13 of the U-profile members 9 are received between the shanks or legs of the end flanges 30 of the H-profile member 12.

The dimensions and spacings of the profile members are appropriately selected to allow a telescoping sliding of the H-profile member 12 along the two U-profile members 9. Thereby, the facing outer sides of the webs 10 of the U-profile members 9 form guide surfaces and a slide bearing for the web 29 of the H-profile member 12 received therebetween. Similarly, the outer surfaces of the shanks or legs 13 of the U-profile members 9 form guide surfaces and a slide bearing for the inner surfaces of the shanks or legs of the flanges 30 of the H-profile member 12. Further preferably, a low friction polymer layer 24 may be arranged on these mutually sliding layers to establish a low friction slide bearing that does not require lubrication with grease or the like.

The two hydraulic cylinders 8 for hydraulically adjusting the extension of the telescopic column 1 are arranged in the hollow spaces within the U-channels of the U-profile members 9 and in the hollow recesses of the H-profile members 12. In order to ensure that the hydraulic cylinders 8 are loaded only under tension and compression, without any torque or pivoting moments, the hydraulic cylinders 8 are connected via pivot bearing blocks 14 and 15 at their opposite ends respectively to the upper telescopic column element 7 and the lower telescopic column element 6 (or equivalently the pedestal of the rotation bearing 5). The bearing blocks 14 and 15 may be bolted onto suitable brackets or for example the pedestal plate mounted on the rotation bearing 5.

The extendable work arm 2 is bolted onto the upper column element 7 via a suitable bracket or flanges. The work arm 2 has the same telescopic structure as the column 1, namely as follows. The work arm 2 comprises a fixed inner work arm element 16 and a telescopically extendable outer work arm element 17 that is telescopically nested or slidingly engaged with the inner work arm element 16. Two hydraulic cylinders 18 are provided to hydraulically drive the adjustable extension or retraction of the outer work arm element 17 relative to the inner work arm element 16. The inner work arm element 16 is preferably formed by two U-profile members 19 such as steel U-beams arranged back-to-back with their respective webs 20 adjacent and spaced apart from one another by a spacing 21. The outer work arm element 17 preferably comprises an H-profile member 22 such as a typical I-beam of steel. For example, the H-profile member 22 is suitably embodied as a commonly known IPB profile member. This H-profile member 22 is arranged with its web 27 received in the space 21 between the two webs 20 of the U-profile members 19. Thereby the shanks or legs 23 of the U-profile members 19 are received between the shanks or legs of the end flanges 28 of the H-profile member 22.

The dimensions and spacings of the profile members are appropriately selected to allow a telescoping sliding of the H-profile member 22 along the two U-profile members 19. Thereby, the facing outer sides of the webs 20 of the U-profile members 19 form guide surfaces and a slide bearing for the web 27 of the H-profile member 22 received therebetween. Similarly, the outer surfaces of the shanks or legs 23 of the U-profile members 19 form guide surfaces and a slide bearing for the inner surfaces of the shanks or legs of the flanges 28 of the H-profile member 22. Further preferably, a low friction polymer layer 24 may be arranged on these mutually sliding layers to establish a low friction slide bearing that does not require lubrication with grease or the like.

The two hydraulic cylinders 18 for hydraulically adjusting the extension of the telescopic work arm 2 are arranged in the hollow spaces within the U-channels of the U-profile members 19 and in the hollow recesses of the H-profile members 22. In order to ensure that the hydraulic cylinders 18 are loaded only under tension and compression, without any torque or pivoting moments, the hydraulic cylinders 8 are connected via pivot bearing blocks at their opposite ends respectively to the two work arm elements. By selectively hydraulically actuating the cylinders 8 and/or 18, the column 1 is extended to the required height, and the work arm 2 is extended to the required horizontal extension position, to bring the tool or tools carried on the receiver 3 to the appropriate position in relation to the wellborn, after manually rotating the manipulator apparatus to the proper rotational orientation about the rotation bearing 5. The pressurized hydraulic oil for the hydraulic cylinders is externally provided to a hydraulic manifold arrangement 25, which is connected by rigid hydraulic pipes 26 to the respective hydraulic cylinders 8 and 18. In this manner, the manipulator apparatus uses only fixed rigid hydraulic pipes and no flexible hydraulic hoses to avoid hydraulic pressure losses and actuating imprecision that can otherwise be caused by such flexible hydraulic hoses. Due to the particular arrangement of the cylinders relative to the column and the work arm, and the construction of the column and the work arm as described above, the hydraulic manifold 25 remains fixed relative to the cylinders 8 and 18, so that such a connection with rigid hydraulic pipes is made possible.

With the above construction of the manipulator apparatus, a purely hydraulic actuation of the telescopic height and extension adjustment is possible, without requiring any electrical control devices. The apparatus is also maintenance free, for example by avoiding bearings that would require greasing or the like, especially through the use of a non-lubricated low-friction polymer (e.g. PTFE) on the slide bearing surfaces. The apparatus construction is simple and robust yet versatile in its applicability. The apparatus includes no articulated joints and no scissors linkages or scissors jacks, which are prone to breakdown and have pinch points and other disadvantages. The actuation can be controlled by a simple Z-X two-axis control for the two groups of cylinders 8 and 18, while a rotation about the vertical axis of the column 1 can be achieved by manually rotating the apparatus on the rotation bearing 5.

Throughout this disclosure, the terms "H-profile" and "I-profile" both mean the same thing, referring to the sectional profile shape of a typical "I-beam". The term "telescopic" refers to the ability to variably extend the length of a multi-element device by relatively sliding two elements that are nested with one element at least partially within the other.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A tool manipulator apparatus for an onshore or offshore drilling platform, for carrying and positioning a drillstring connecting tool for clamping and/or screwing pipe connections of drill pipes of a drillstring of the drilling platform, said manipulator apparatus comprising a height-adjustable column and a variably-extendable work arm carried by said column, wherein:

a free end of said work arm extending away from said column is adapted to carry the drillstring connecting tool;

said column comprises two first U-profile members and a first H-profile member received slidably between said two first U-profile members so that said first H-profile member is telescopically slidably extendable relative to said two first U-profile members;

said column further comprises at least one first hydraulic cylinder with opposite ends thereof respectively connected to said first H-profile member and to said two first U-profile members;

said work arm comprises two second U-profile members and a second H-profile member received slidably between said two second U-profile members so that said second H-profile member is telescopically slidably extendable relative to said two second U-profile members;

said work arm further comprises at least one second hydraulic cylinder with opposite ends thereof respectively connected to said second H-profile member and to said two second U-profile members;

said two first U-profile members each respectively have a base web and two leg flanges extending from said base web, said first H-profile member has a center web and two end flanges at opposite edges of said center web, said two first U-profile members are arranged back-to-back with said base webs thereof facing one another, extending parallel to one another, and spaced apart from one another with a first space therebetween, said center web of said first H-profile member is received telescopically slidably in said first space between said base webs of said two first U-profile members, and said two leg flanges of each respective one of said two first U-profile members are nested telescopically slidably between said two end flanges of said first H-profile member respectively on each side of said center web of said first H-profile member; and said two second U-profile members each respectively have a base web and two leg flanges extending from said base web, said second H-profile member has a center web and two end flanges at opposite edges of said center web, said two second U-profile members are arranged back-to-back with said base webs thereof facing one another, extending parallel to one another, and spaced apart from one another with a second space therebetween, said center web of said second H-profile member is received telescopically slidably in said second space between said base webs of said two second U-profile members, and said two leg flanges of each respective one of said two second U-profile members are nested telescopically slidably between said two end flanges of said second H-profile member respectively on each side of said center web of said second H-profile member.

2. A tool manipulator apparatus adapted to carry and position a tool, said manipulator apparatus comprising a height-adjustable column and a variably-extendable work arm carried by said column, wherein:

a free end of said work arm extending away from said column is adapted to carry the tool;

said column comprises two first U-profile members and a first H-profile member received slidably between said two first U-profile members so that said first H-profile member is telescopically slidably extendable relative to said two first U-profile members;

said column further comprises at least one first hydraulic cylinder with opposite ends thereof respectively connected to said first H-profile member and to said two first U-profile members;

said work arm comprises two second U-profile members and a second H-profile member received slidably between said two second U-profile members so that said second H-profile member is telescopically slidably extendable relative to said two second U-profile members; and said work arm further comprises at least one second hydraulic cylinder with opposite ends thereof respectively connected to said second H-profile member and to said two second U-profile members.

3. The tool manipulator apparatus according to claim 2, wherein said column extends vertically and said work arm extends horizontally.

4. The tool manipulator apparatus according to claim 2, further comprising a rotation bearing, wherein said column is mounted on said rotation bearing, with a longitudinal extension axis of said column aligned with a rotation axis of said rotation bearing.

5. The tool manipulator apparatus according to claim 2, wherein:

said two first U-profile members each respectively have a base web and two leg flanges extending from said base web, said first H-profile member has a center web and two end flanges at opposite edges of said center web, said two first U-profile members are arranged back-to-back with said base webs thereof facing one another, extending parallel to one another, and spaced apart from one another with a first space therebetween, said center web of said first H-profile member is received telescopically slidably in said first space between said base webs of said two first U-profile members, and said two leg flanges of each respective one of said two first U-profile members are nested telescopically slidably between said two end flanges of said first H-profile member respectively on each side of said center web of said first H-profile member, and said two second U-profile members each respectively have a base web and two leg flanges extending from said base web, said second H-profile member has a center web and two end flanges at opposite edges of said center web, said two second U-profile members are arranged back-to-back with said base webs thereof facing one another, extending parallel to one another, and spaced apart from one another with a second space therebetween, said center web of said second H-profile member is received telescopically slidably in said second space between said base webs of said two second U-profile members, and said two leg flanges of each respective one of said two second U-profile members are nested telescopically slidably between said two end flanges of said second H-profile member respectively on each side of said center web of said second H-profile member.

6. The tool manipulator apparatus according to claim 2, wherein said two first U-profile members of said column are mounted fixedly on a pedestal base, said first H-profile member of said column is vertically telescopically variably extendable relative to said two first U-profile members, said two second U-profile members of said work arm are mounted fixedly on said first H-profile member of said column, and said second H-profile member of said work arm is horizontally telescopically variable extendable relative to said two second U-profile members.

7. The tool manipulator apparatus according to claim 6, wherein each said at least one first hydraulic cylinder respectively has a cylinder end thereof connected to an upper end of said first H-profile member and a piston rod end thereof connected to a lower end of said first U-profile members of said column, and each said at least one second hydraulic cylinder respectively has a cylinder end thereof connected to a fixed end of said second U-profile members connected to said first H-profile member and a piston rod end thereof connected to said free end of said work arm comprising a free end of said second H-profile member of said work arm.

8. The tool manipulator apparatus according to claim 6, further comprising a hydraulic manifold arrangement mounted on said first H-profile member of said column and/or on said two second U-profile members of said work arm, and rigid hydraulic pipes connecting said hydraulic manifold arrangement to said at least one first hydraulic cylinder and said at least one second hydraulic cylinder.

9. The tool manipulator apparatus according to claim 2, further comprising rigid hydraulic pipes connected to said at least one first hydraulic cylinder and said at least one second hydraulic cylinder, and excluding flexible hydraulic hoses.

10. The tool manipulator apparatus according to claim 2, wherein said at least one first hydraulic cylinder includes two first hydraulic cylinders respectively arranged in two respective U-channels defined in and along said two first U-profile members, and said at least one second hydraulic cylinder includes two second hydraulic cylinders respectively arranged in two respective U-channels defined in and along said two second U-profile members.

11. The tool manipulator apparatus according to claim 2, further comprising respective pivot bearing blocks respectively connecting said opposite ends of said at least one first hydraulic cylinder to said members of said column and connecting said opposite ends of said at least one second hydraulic cylinder to said members of said work arm.

12. The tool manipulator apparatus according to claim 2, further comprising a tool receiver that is mounted on said free end of said work arm and that is configured and adapted to carry various different tools including said tool selected from a group of drillstring connecting tools consisting of controllable clamping tools and screwing tools for clamping and screwing pipe connections of drillpipes of a drillstring of a drilling platform.

13. The tool manipulator apparatus according to claim 12, wherein said tool receiver comprises a transverse yoke beam that extends transversely to said work arm at said free end thereof and that has tool receiver fittings provided thereon and/or on said free end of said work arm.

14. The tool manipulator apparatus according to claim 12, further in combination with and including said tool carried on said tool receiver.

15. The tool manipulator apparatus according to claim 2, further in combination with and mounted rotatably about a vertical rotation axis on a drilling platform floor of an onshore or offshore drilling platform.

16. The tool manipulator apparatus according to claim 2, further comprising a low-friction polymer layer respectively arranged on at least one surface of mutually facing and slidingly contacting surfaces of said first H-profile member and said two first U-profile members, and on at least one surface of mutually facing and slidingly contacting surfaces of said second H-profile member and said two second U-profile members, to form low-friction slide bearings between said members that are telescopically slidable relative to one another.

* * * * *